United States Patent [19]

Vallée

[11] 4,185,436

[45] Jan. 29, 1980

[54] METAL SHINGLE ROOF TRADITIONAL DESIGN

[76] Inventor: Louis L. Vallée, 6392 Maubourg Ave., Montreal, Quebec, Canada, H1M 2C8

[21] Appl. No.: 892,162

[22] Filed: Mar. 31, 1978

[30] Foreign Application Priority Data

Dec. 14, 1977 [CA] Canada ..... 293026

[51] Int. Cl.[2] ..... E04D 1/00

[52] U.S. Cl. ..... 52/518; 52/530; 52/554

[58] Field of Search ..... 52/529-531, 52/518, 554, 57, 15

[56] References Cited

U.S. PATENT DOCUMENTS

| | | | |
|---|---|---|---|
| 1,775,927 | 9/1930 | Becker | 52/554 |
| 2,271,728 | 2/1942 | Bainbridge | 52/554 |
| 2,305,008 | 12/1942 | Howard | 52/528 |
| 2,340,038 | 1/1944 | Baczkowski | 52/554 |
| 2,867,180 | 1/1959 | May | 52/554 |
| 3,381,426 | 5/1968 | Heidrich | 52/57 |
| 4,014,152 | 3/1977 | Vallee | 52/528 |

FOREIGN PATENT DOCUMENTS

| | | | |
|---|---|---|---|
| 29296 | 10/1957 | Finland | 52/518 |
| 2765 | of 1903 | United Kingdom | 52/554 |
| 191606 | 1/1923 | United Kingdom | 52/518 |

*Primary Examiner*—James A. Leppink
*Assistant Examiner*—Henry E. Raduazo
*Attorney, Agent, or Firm*—Larson, Taylor and Hinds

[57] ABSTRACT

A sheet metal starter shingle and a sheet metal roof covering employing the starter shingles. The starter shingle has an upwardly sloping top edge upon which a plurality of rectangular sheet metal roofing shingles can be mounted in a row. Each starter shingle initiates a new row of roofing shingles which new row continues over a previous row. The shingles all engage with each other and with the eave and gable edges of a roof.

20 Claims, 16 Drawing Figures

METAL SHINGLE ROOF TRADITIONAL DESIGN

This invention is directed toward improved sheet material roofing shingles.

The invention is also directed toward an improved sheet material roof covering.

The invention is further directed toward a method for making an improved, sheet material, roof covering.

Sheet material shingles and roof coverings made from such shingles are well known. The shingles are usually made from sheet metal and are used to increase the life of the roof. The shingles are usually provided with integral means whereby they can engage with each other in overlapping fashion to facilitate formation of the roof covering and to attempt to improve the water resistance of the roof covering. The integral engaging means on the shingles makes it very important to properly align the first or starter shingle row as it is laid on the roof at the eaves since each succeeding shingle row depends, for its alignment, on the alignment of the preceding row. Normally, the starter row is composed of the same shingles used on the remainder of the roof. Some, or all, of these prior art starter shingles may be cut from the roof shingles so that a definite repeating pattern can be followed. Also, a large number of shingles must be handled in the starter row. This increases the chances of misalignment. Because of the cutting and fitting, the aligning, and the number of shingles handled, a great deal of time is required to lay a properly aligned starting row.

To provide better weatherproofing many of the sheet material roof coverings employ square shingles set with their sides at a 45 angle to the vertical. The joint at this angle between shingles minimizes the entry of water, and horizontal joints are avoided. The starter shingles thus usually comprise triangular shingles formed by cutting the square shingles in half. While the arrangement is satisfactory, little pattern variation is obtained and traditional sheet material shingle patterns are avoided.

The present invention provides an improved sheet material roofing shingle which is specifically designed as a starter shingle. This starting shingle permits a starting shingle row to be laid down quickly and accurately with a minimum of cutting and fitting. The starting shingle row formed by the starting shingles also permits succeeding rows of sheet material roofing shingles to be quickly and accurately laid down as well. The starting shingles minimize misalignment of the remaining rows of shingles so that a good, weatherproof fit is obtained over the entire roof along with a uniform, pleasing appearance. The starting shingles incorporate means for engaging with the other roof shingles in a manner which facilitates rapid assembly of the roof covering and minimizes water leakage.

The roofing shingles employed with the starter shingles in the roof covering of the present invention preferably are rectangular in shape with means for engaging with each other and with the starter shingles. The rectangular roof shingles are laid in a manner to have the rectangular shingles in one row staggered with respect to the rectangular shingles in the adjacent rows.

The combination of the novel starter and roofing shingles results in the rows of roofing shingles slanting across the roof in more traditional patterns. The novel starter shingles also provide a more distinctive and traditional appearance for the roof. Horizontal joints are avoided to minimize water entry.

The present invention provides an improved roof covering made with sheet material shingles which is easy to construct, pleasing in appearance, and substantially weatherproof in construction.

The present invention further provides a method for constructing such a roof.

A further purpose of the present invention is to provide an improved roof covering having eave and gable strips which facilitate construction of the roof covering. It is another purpose of the present invention to provide an improved roof covering having improved ridge shingles which provide a weatherproof seal.

The invention is particularly directed toward a sheet material starter shingle for use in shingling a roof which shingle has a first, long straight side adapted to receive a number of roofing shingles. Second and third short straight sides extend perpendicularly to the first side with the third side being substantially longer than the second side. The third side has a length at least substantially equal to the length of a roofing shingle. The starter shingle also has a long, straight fourth side between the second and third sides adapted to be attached to the eave edge of a roof.

Preferably, the third side of the starter shingle has a length equal to the length of a roofing shingle plus the length of the second side.

The invention is also directed toward a roof covering having a row of sheet material, starter shingles and a plurality of quadrangular sheet material, roofing shingles. Each starter shingle has a first, long, straight top side adapted to receive a number of the roofing shingles. The starter shingle includes second and third short, straight sides extending perpendicularly to the first side with the third substantially longer than the second side with a length at least equal to the length of a roofing shingle. The fourth side is adapted to be attached to the eave of a roof. The remaining roofing shingles cover the roof in rows parallel to the first sides of the starter shingles.

The invention is further directed toward a method for use in laying a roof covering with sheet material starter and roofing shingles. The method comprises the steps of first laying a row of engaged starter shingles on the roof adjacent the eave with each starter shingle having a top straight edge angling upwardly relative to the bottom eave edge from a low end toward one side of the roof. Then a first row of roofing shingles is laid on the top edge of the one starter shingle closest the one side of the roof. The first shingle of the row to be laid is at the low end of the starter shingle and engages both the adjacent starter shingle and the one starter shingle. Each succeeding roofing shingle of the row engages the one starter shingle and the preceding roof shingle. A second row of roofing shingles is then laid on the top edge of the adjacent starter shingle, starting from its low end, and continuing on the top edges of the roofing shingles of the first row but staggered with respect to them. The second row of roofing shingles engage with each other, and the top edge of the adjacent starter shingle or the top edges of the first row of roofing shingles. In addition the first shingle of the second row engages with third starter shingle.

The invention will now be described in detail having reference to the accompanying drawings in which.

Figures 1, 2:
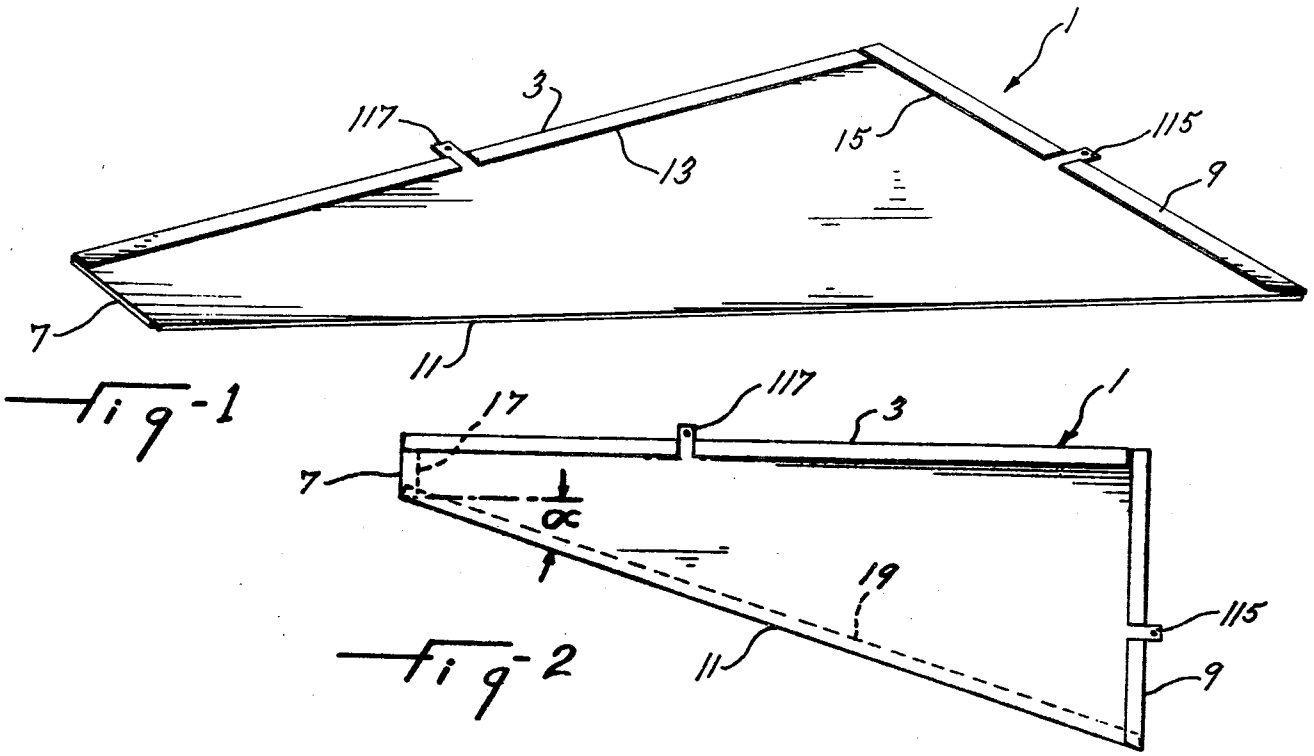
FIG. 1 is a perspective view of a starter shingle.
FIG. 2 is a plan view of the starter shingle.
Figures 12, 13, 14, 15, 16:
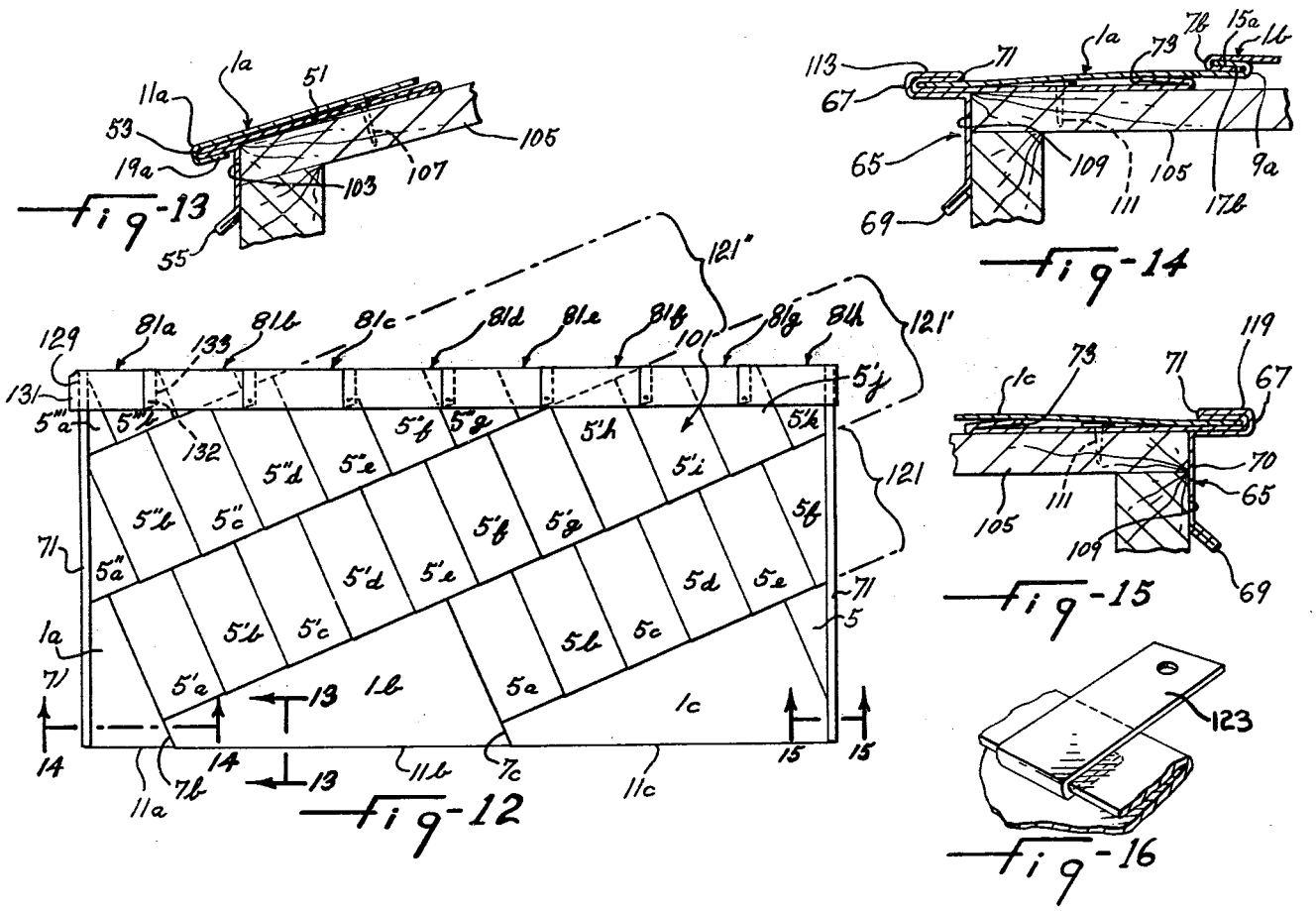
FIG. 12 is a plan view of a roof covering incorporating the shingles and edging strips.
FIG. 13 is a cross-section view taken along line 13—13 of FIG. 12.
FIG. 14 is a cross-section view taken along line 14—14 of FIG. 12.
FIG. 15 is a cross-section view taken along line 15—15 of FIG. 12.
FIG. 16 is a perspective view of a clip.

As shown in FIGS. 1, 2 and 12, the starter shingle 1 of the present invention has a first long, straight side 3 for receiving a number of roofing shingles 5. Second and third short, straight sides 7, 9 extend perpendicularly from the first side 3. the third side 9 is longer than the second side 7 and has a length at least substantially equal to the length of a roofing shingle 5 and preferably, equal to the length of a roofing shingle plus the side 7. A fourth, long straight side 11 joins the second and third sides. This fourth side 11 lies adjacent the eave edge of a roof.

Engaging means are provided on all four sides 3, 7, 9, 11 for engaging with the sides of adjacent starter shingles, with the sides of roofing shingles, and with the eave edge. On the first and third sides 3, 9, the engaging means comprises overturned lips 13, 15 respectively. On the second and fourth sides 7, 11 the engaging means comprises underturned lips 17, 19 respectively.

Each starter shingle 1 preferably is relatively large compared to each roofing shingle 5. The starter shingle 1 can be sized to carry only one, plus a part of a second roofing shingle 5 on its shingle carrying to edge or side 3. On the other hand, twenty or more roofing shingles plus a part of another shingle can be mounted on side 3. Preferably, between three and seven shingles, plus part of another shingle are mounted on side 3. FIG. 12 shows four full roofing shingles, plus part of a fifth roofing shingle mounted on the side 3 of each starter shingle.

The angle $\alpha$ between the two long sides 3, 11 varies between 5° and 40°. Preferably the angle ranges between 15° and 30° when between three and seven roofing shingles are mounted on side 3. The steeper the angle, the less roofing shingles are carried by each starter shingle. The angle $\alpha$ determines the angle at which each row or course of roofing shingles 5 will run across the roof.

Figure 3:
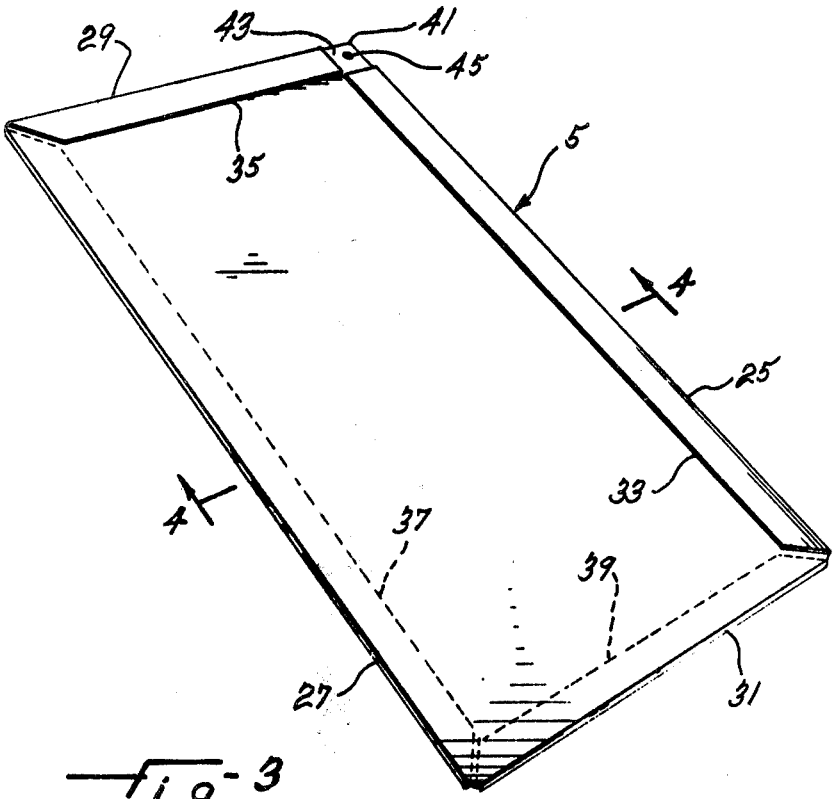
FIG. 3 is a perspective view of a roofing shingle.
Figure 4:
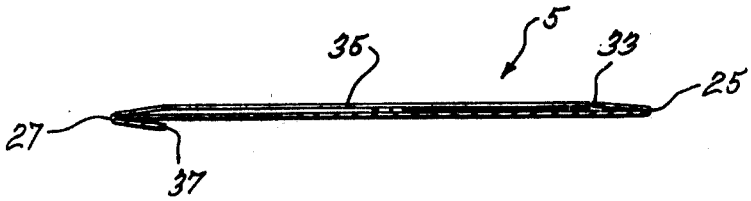
FIG. 4 is a cross-section view of the roofing shingle taken along line 44 of FIG. 3.

Each roofing shingle 5, as shown in FIGS. 3 and 4 is quadrangular in shape, preferably rectangular, having two long sides 25, 27 and two short sides 29, 31. Engaging means are provided on all four sides for engaging the sides of adjacent roofing and starter shingles. These engaging means comprise overturned lips 33, 35 on adjacent sides 25, 29 and underturned lips 37, 39 on the other sides 27, 31. The lips 33, 35 are preferably cut away at the corner 41 where they meet, exposing an attachment area 43. An aperture 45 may be provided in area 43 for receiving a fastener. The starter and roofing shingles are assembled on a roof to form a roof covering as will be described.

Figure 5:
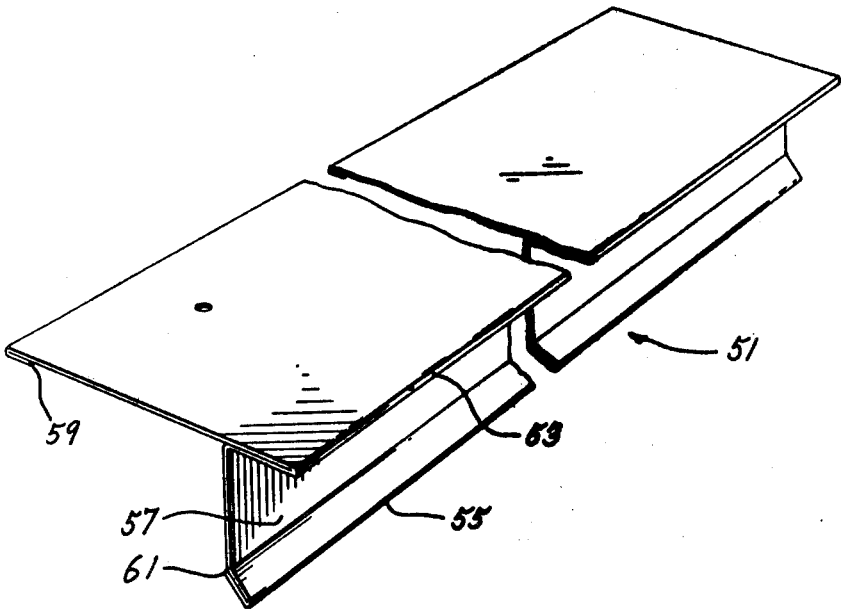
FIG. 5 is a perspective view of an eave strip.
Figure 6:
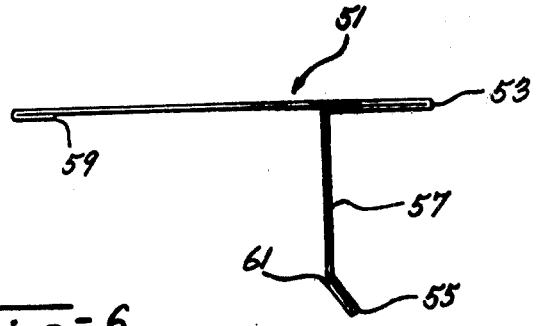
FIG. 6 is an end view of the eave strip.

The roof covering includes eave strips 51 shown in FIGS. 5 and 6. Each eave strip 51 has a projecting edge 53. A drip edge 55 is located below projecting edge 53, joined to the strip 51 with a web 57. The strip can be formed from a single piece of material, bent double at one side to form projecting edge 53, then down to form web 57, and out to form drip edge 55. The free edges 59, 61 of the strip 51 can be folded under.

Figure 7:
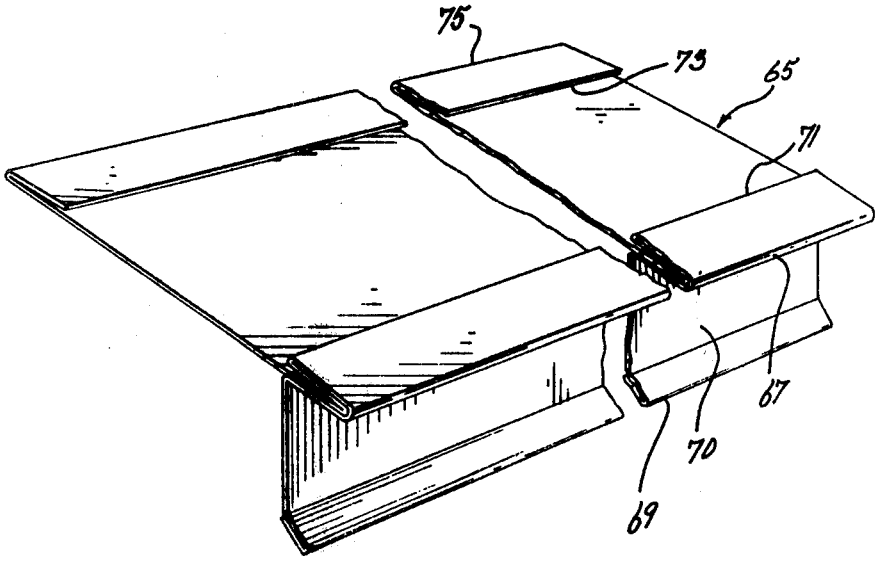
FIG. 7 is a perspective view of a gable strip.
Figure 8:
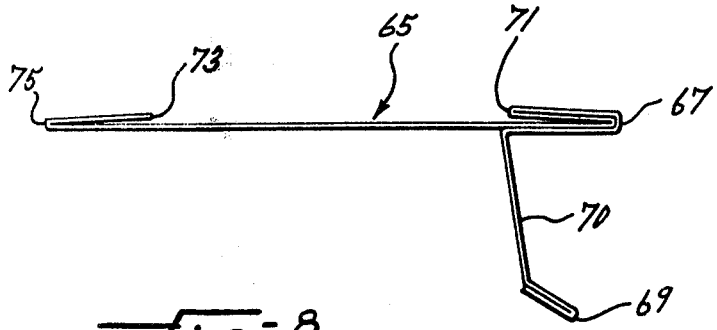
FIG. 8 is an end view of the gable strip.

Gable strips 65 are also provided as shown in FIGS. 7 and 8. Each gable strip 65 has a projecting edge 67 and a drip edge 69 beneath projecting edge 67 and joined thereto by a web 70. In addition, a first overturned lip 71 is provided on the top of edge 67 and a second overturned lip 73 is provided along side 75 of the strip. The gable strip 65 can be formed from a single piece of material bent to form the lips, edges and web.

Figure 9:
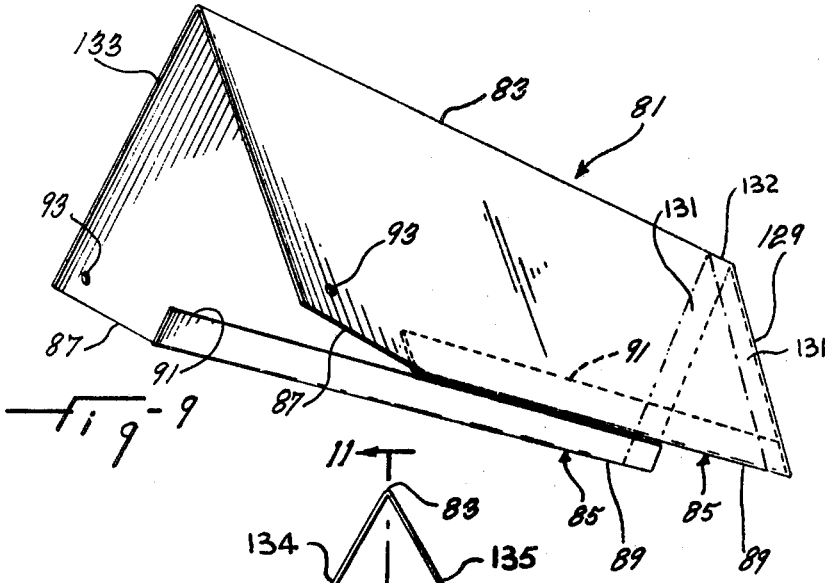
FIG. 9 is a perspective view of a ridge shingle.
Figure 10:
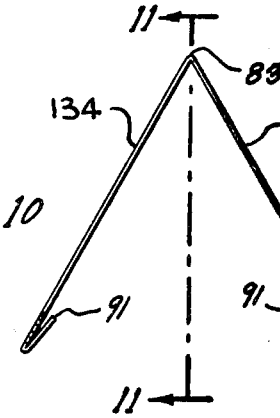
FIG. 10 is an end view of the ridge shingle.
Figure 11:
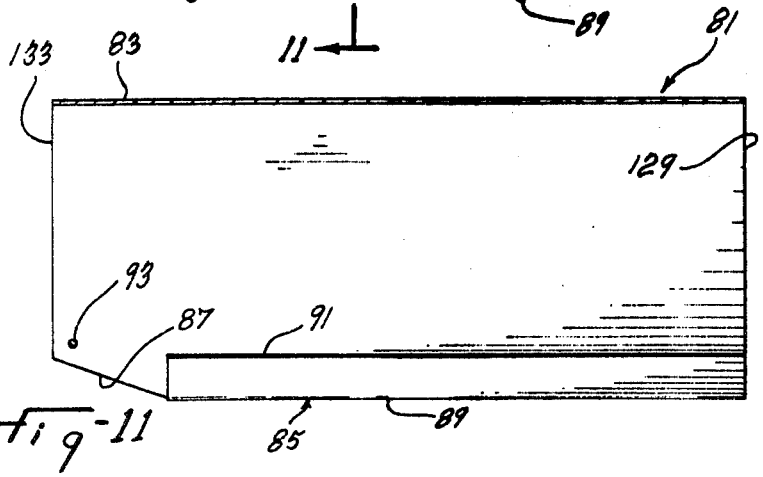
FIG. 11 is a cross-section view taken along line 11—11 of FIG. 10.

The roof covering includes ridge shingles 81 as shown in FIGS. 9 to 11. Each ridge shingle 81 has a substantially V-shape with a central fold line 83 and two long sides 85 generally parallel to fold line 83. Both sides 85 have a short, upwardly angled straight portion 87 and a long, straight portion 89 parallel to fold line 83. Underturned lips 91 are provided on each long side portion 89. A fastening aperture 93 may be provided adjacent short side portion 87.

The roof covering 101, employing the above components, is shown in FIG. 12 and is assembled in the following manner.

An eave strip 51, as shown in FIG. 13 is first secured along the bottom edge 103 of the roof 105 by means of screws or nails 107. The projecting edge 53 of the eave strip 51 extends beyond the edge 103 of the roof and provides a structure over which the starter shingles can be secured. This edge 53 is carefully aligned when fastening strip 51.

Gable strips 65 are then secured to both gable ends 109 of the roof 105 by screws of nails 111 as shown in FIGS. 14 and 15.

Each gable strip 65 extends from the peak of the roof down to the eave edge 103 and overlies the eave strip 51.

A first, partial, starter shingle 1*a* is placed on the left hand side of the roof. This shingle 1*a* is formed by cutting a full starter shingle 1 along a line perpendicular to side 11 and retaining the part having third side 9. The width of the partial starter shingle 1*a* is not critical. For the best appearance the partial shingle should be between about one-half and three roofing shingles wide. If the partial shingle is wider than this the placement of the roofing shingles which are secured to the top of the partial starter can become complicated.

The left hand cut side 113 of the partial starter 1*a* is slipped under the lip 71 of the gable strip 65 as shown in FIG. 14. The partial starter covers the overturned lip 73 on the gable strip 65. Lip 73 acts as a water stop and carries any water that seeps under the gable edges of the shingles down to the eave. The lip 19 on the bottom side 11 of shingle 1*a* is also fitted under projecting edge 53 of eave strip 51 as shown in FIG. 13, and the shingle 1*a* is then pushed up snugly against edge 53 to ensure proper alignment of top side 3. Shingle 1*a* is then secured to roof 105. This can be done by employing a clip 123 as shown in FIG. 16 or alternatively a fastening strap 115 on side 9 can be formed by cutting a width of overturned lip 15 and bending it outwardly and flat against the roof structure as shown in FIG. 1. a fastener through strap 115 secures shingle 1*a* to the roof.

A second, full starter shingle 1*b* is then fitted in place. Lip 17*b* on short side 7*b* slides over and then under a portion of lip 15*a* on side 9*a* of starter 1*a* as shown in FIG. 14. Also, lip 19*b* on bottom side 11*b* is hooked over eave strip edge 53. A clip 123 or a strap 117, formed from lip 13 in the same manner as strap 115, is used to fasten shingle 1*b* to the roof. Additional starter shingles 1, if needed, are added in a similar manner working toward the right hand edge of the roof.

The last starter shingle 1*c* is cut at its right side along a line 119 perpendicular to side 11*c* to fit under lip 71 on the gable strip 65 at the right hand roof edge. Lip 19*c* hooks over the eave strip edge 53, and the overturned lip 15*b* of the preceding starter shingle 1*b* engages with lip 17*c*. A strap 117 can be used to fix shingle 1*c* in place. This completes the starter row.

The first roofing shingle 5 on the right hand side of starter shingle 1*c* is formed from a standard roofing shingle 5. The standard shingle is cut on its right side to slip under lip 71 on the gable strip 65. The under lip 37 on side 27 is engaged with the overturned lip 15*c* on side 9*c* of starter shingle 1*c*. care is taken to ensure that edge 29 of shingle 5 is aligned with edge 3*c* of starter shingle 1*c*. Shingle 5 can be secured by a clip 123 which can be attached to overturned lip 35 as shown in FIG. 16. and nailed to the roof 105. Alternatively, a strap similar to straps 115 or 117, formed on side 29, can be used to secure the shingle.

Roofing shingles 5 are now placed on the roof. A first row 121 of roofing shingles 5*a*, 5*b*, 5*c*, etc., are placed first. This first row 121 is positioned on the starter shingle at one side of the roof. This side is the side toward which the top side 3 of each starter slopes upwardly. In this case, the row 121 is placed on shingle 1*c*, and more particularly, on top side 3*c* of shingle 1*c*. The first shingle 5*a* is positioned at the lowest end of side 3*c*, in this case, to the left, above and adjacent side 7*c*. The underturned lips 37, 39 of the shingle 5*a* are engaged with the overturned lip 15*b* on side 9*b* of adjacent starter shingle 1*b* and the overturned lip 13*c* on side 3*c* of shingle 1*c* respectively. The shingle is fixed with a nail or screw driven through the aperture 45 in the upper open corner 41 of the shingle. The next roof shingle 5*b* is connected, via its underturned lips 37, 39 to lip 33 on roof shingle 5*a* and to lip 13*c* on starter shingle 1*c*. This shingle 5*b* overlaps the side of shingle 5*a* and covers the nail in shingle 5*a*. Another nail in the open, upper corner of shingle 5*b* secures shingle 5*b* in place. The remaining shingles 5*c*, 5*d* in row 121 are secured to the roof in a similar manner. The last shingle 5*f* is cut on its right side to slip under the lip 71 on the gable strip 65. A clip 123 can be attached to its overturned lip 35 as shown in FIG. 16 and nailed to the roof 105 to fix the shingle 5*f* in place. Alternatively, a strap similar to straps 115 or 117 formed on side 29 can be used to secure shingle 5*f*. It will be noted that the top sides 29 of the roof shingles 5 fixed to starter shingle 1*c* are aligned with the top first side 3*b* of the adjacent starter shingle 1*b*.

A second row 121' of roof shingles 5' is next put on the roof. This next row of shingles starts on the next starter shingle 1*b* at its low end adjacent starter shingle 1*a*. The first shingle 5'*a* of the row is placed with its underturned lips 37, 39 on sides 27, 31 hooked over the lips 15*a* on side 9*a* of starter 1*a*, and the lip 13*b* on side 3*b* of starter 1*b* respectively. A nail in its upper, open 41 corner secures shingle 5'*a* in place. The remaining shingles 5'*b*, 5'*c*, etc., are put on in the same manner as the shingles in row 121. The shingles at the right hand end of row 121' are cut to fit the right hand roof edge or the roof ridge. Again it will be seen that the top sides 29 of the shingles 5' are all aligned with the top first side 3*a* of the adjacent starter shingle 1*a* forming a straight mounting line for the next row of shingles 121''.

It will also be noted, because of the length of the first, top side 3*b* of starter shingle 1*b*, that the shingles 5' in row 121' are staggered with respect to the shingles 5 in row 121 with each shingle 5' in row 121' having its underturned lip 39 on side 31 hooked over the overturned lips 35 of sides 29 of two adjacent shingles 5 in row 121.

Additional rows of shingles are put on to complete the roof covering with the first shingles to the left of the rows as shown in FIG. 12 cut to fit under the lip 71 of the gable strip 65 at the gable edge. A fastening strap similar to strap 115 or a clip similar to clip 123 may be used to fix the first cut shingle of each row in place. Each new row is positioned to be staggered with respect to the preceding row.

When the roof has been shingled up to the peak, the ridge shingles 81 are put on. The first ridge shingle 81*a* is formed with underturned lips on the other ends 129 of panels 134, 135 opposite end 133. The lips can be formed by making a short cut 132 inwardly from end 129 along ridge line 83 and folding the so formed lips 131 inwardly. The cut 132 and lips 131 are shown by dot-dash lines in FIG. 9. This first ridge shingle 81*a* is placed on the ridge overlying the roofing shingles 5 on both sides of the roof with the lips 131 hooked under the gable edges 67 on the left hand side of the roof. The other end of the ridge shingle 81*a* is fastened to the roof by fasteners through apertures 93*a*. The end 129*b* of second ridge shingle 81*b* is slid over the end 133*a* of the first shingle, covering the fasteners and with lips 91*b* sliding under and interlocking with edges 87*a*. Fasteners through apertures 93*b* fasten the shingle 81*b* to the roof. The remaining ridge shingles are fastened in a similar manner.

The last ridge shingle is cut to fit the space left to cover on the ridge. The last ridge shingle is cut to provide lips 131 at the end away from outside end 129. This last ridge shingle is placed to overlap and cover the preceding shingle. The inturned lips 91 of the last shingle receive the angle side portions 87 of the preceding shingle to lock end 129 and the outer end of the last ridge shingle is secured by folding lips 131 over and under the edge 67 of the gable strip 65. The ridge shingles 81 complete the roof covering 101.

To further improve the waterproof properties of the roof, the fasteners 107 and 111 used to secure the eave member 51 and the gable members 65 can be sealed using a suitable sealing compound such as silicon. It has been found that other fasteners used to secure the shingles are adequately protected by the design of the roof and do not require sealing.

The embodiments of the invention in which an exclusive property or privilege is claimed are defined as follows:

1. A sheet material starter shingle for use in shingling a roof with quadrangular roofing shingles of a certain length, the starter shingle having a first, long straight side adapted to receive a number of quadrangular roofing shingles of a certain length; second and third short, straight sides extending perpendicularly to the first side, the third side being substantially longer than the second side with a length at least equal to the length of a quadrangular roofing shingle; and a fourth long, straight side between the second and third sides, the fourth side adapted to be attached to the eave edge of a roof.

2. A shingle as claimed in claim 1 wherein the third side has a length equal to the length of a roofing shingle plus the length of the second side.

3. A shingle as claimed in claim 2 wherein the first and third sides of the starter shingle have an overturned lip for use in engaging adjacent roofing shingles and the second and fourth sides have an underturned lip for use in engaging an adjacent starter shingle and the eave edge of the roof, respectively.

4. A shingle as claimed in claim 3 wherein the angle between the first and fourth sides is between 5° and 40°.

5. A shingle as claimed in claim 3 wherein the first side has a length equal to between three and seven widths of a roofing shingle, plus part of the width of another roofing shingle.

6. A roof covering having a row of sheet material starter shingles and a large number of quadrangular sheet material, roofing shingles, each starter shingle having a first, long straight top side adapted to receive a small number of the roofing shingles; second and third short, straight sides extending perpendicularly to the first side, the third side being substantially longer than the second side with a length at least equal to the length of a roofing shingle; and a fourth long, straight side between the second and third sides, the fourth side adapted to be attached to the eave edge of a roof; the remaining roofing shingles covering the roof in rows parallel to the first sides of the starter shingles.

7. A roof covering as claimed in claim 6 wherein the top sides of the roof shingles received on one starter shingle, are aligned with the top side of an adjacent starter shingle at the second side of the one starter shingle.

8. A roof covering as claimed in claim 7 wherein the first and third sides of each starter shingle have an overturned lip for engaging adjacent roofing shingles, and the second and fourth sides have an underturned lip for engaging an adjacent starter shingle and the eave edge of the roof respectively.

9. A roof covering as claimed in claim 8 wherein the first side has a length equal to between three and seven widths of a roofing shingle, plus part of the width of another roofing shingle.

10. A roof covering as claimed in claim 8 wherein each roof shingle has two adjacent sides with overturned lips for engaging sides of adjacent roof shingles, and the other two adjacent sides of the roof shingle have underturned lips for engaging with the sides of adjacent roof or starter shingles.

11. a roof covering as claimed in claim 10 wherein the overturned lips of each roofing shingle are cut back at the corner where they meet to provide a fastening area at a top corner of the shingle.

12. A roof covering as claimed in claim 10 wherein the roof shingles are rectangular in shape, the roof shingles engaged with the first side of each starter shingle with a short side and with the third side of each starter shingle with a long side.

13. A roof covering as claimed in claim 8 wherein the first roofing shingle engaged with the first side of a starter shingle is aligned with the second side of the starter shingle and the last roofing shingle engaged with the first side of the starter shingle extends past the third side of the starter shingle.

14. A roof covering as claimed in claim 11 including an aperature in the fastening area to receive a fastener.

15. A roof covering as claimed in claim 6 including a plurality of sheet material ridge shingles, each ridge shingle having a generally V-shape and applied to the ridge of a roof to overlie the roofing shingles at the roof ridge, each side of the ridge shingle having a major portion parallel to the ridge line and a minor portion at one end angled upwardly, the major portion of each side having an underturned lip.

16. A roof covering as claimed in claim 15 including a fastening aperature above each minor side portion.

17. A roof covering as claimed in claim 6 including a sheet material gable strip for attaching to the gable edges of a roof, each gable strip having an overturned lip along each side and a drip edge below one side, the starter shingle and roofing shingles adjacent each gable strip slipped under the lip at the one side and lying over the other lip.

18. A roof covering as claimed in claim 6 including a sheet material eave strip for attaching to the eaves of a roof, each eave strip having a straight projecting edge engaged by the fourth side of the row of starter shingles and a drip edge below the projecting edge.

19. A method for use in laying a roof covering with sheet material starter and roofing shingles comprising the steps of first laying a row of engaged starter shingles on the roof adjacent the eave with each starter shingle having a top straight edge angling upward, relative to its bottom eave edge, from a low end toward one side of the roof; laying a first row of roofing shingles on the top edge of the one starter shingle closest the one side of the roof, with the first shingle of the row to be laid at the low end of the starter shingle and engaging both the adjacent starter shingle and the one starter shingle; each succeeding roofing shingle of the row engaging the preceding roofing shingle and the one starter shingle; laying a second row of roofing shingles on the top edge of the next adjacent starter shingle starting from its low end, the second row continuing on the top edges of the roofing shingles of the first row, but staggered with respect to them, to the one side of the roof, the second row of roofing shingles engaging each other and the top edge of the adjacent starter shingle or the top edges of the first row of roofing shingles; and continuing with a row of roofing shingles for each starting shingle.

20. A method as claimed in claim 19 including the steps of first fastening a sheet material eave strip to the eave of the roof and then fastening sheet material gable strips to the gable edges of the roof before laying down the starter row.

* * * * *